US009246202B1

(12) United States Patent
Barker et al.

(10) Patent No.: US 9,246,202 B1
(45) Date of Patent: Jan. 26, 2016

(54) LOW IMPEDANCE CIRCULATOR

(71) Applicant: MERCURY COMPUTER SYSTEMS, INC., Chelmsford, MA (US)

(72) Inventors: Ken Barker, Oakdale, CA (US); David Cassens, San Jose, CA (US); Michael Pitchell, Los Banos, CA (US)

(73) Assignee: MERCURY SYSTEMS, INC., Chelmsford, MA (US)

( * ) Notice: Subject to any disclaimer, the term of this patent is extended or adjusted under 35 U.S.C. 154(b) by 189 days.

(21) Appl. No.: 14/051,011

(22) Filed: Oct. 10, 2013

(51) Int. Cl.
*H01P 1/387* (2006.01)
*H01P 1/38* (2006.01)

(52) U.S. Cl.
CPC . *H01P 1/38* (2013.01); *H01P 1/387* (2013.01)

(58) Field of Classification Search
CPC ..... H01P 1/387; H01P 1/32; H01P 1/38
USPC ..... 333/1.1, 24.2
See application file for complete search history.

(56) References Cited

U.S. PATENT DOCUMENTS

| | | | | |
|---|---|---|---|---|
| 7,242,264 | B1 * | 7/2007 | How | 333/1.1 |
| 2001/0017576 | A1 | 8/2001 | Kondo et al. | |
| 2007/0182504 | A1 | 8/2007 | Mukai et al. | |
| 2010/0109791 | A1 | 5/2010 | Lingel | |

OTHER PUBLICATIONS

International Search Report and Written Opinion of the International Searching Authority issued in International Application No. PCT/US2014/058798 dated Dec. 11, 2014.

* cited by examiner

*Primary Examiner* — Stephen E Jones
(74) *Attorney, Agent, or Firm* — Nelson Mullins Riley Scarborough LLP

(57) ABSTRACT

A circulator may include a first port having a first port impedance matching circuit defining an impedance of the first port, a second port having a second port impedance matching circuit defining an impedance of the second port, and a third port having a third port impedance matching circuit defining an impedance of the third port. In an example embodiment, the impedance of the first port may be provided to match an impedance of a first external circuit, the impedance of the second port may be provided to match an impedance of a second external circuit, and the impedance of the third port may be provided to match an impedance of a third external circuit. The impedance of the third port may be different than the impedance of the first port.

14 Claims, 3 Drawing Sheets

LOW IMPEDANCE CIRCULATOR

TECHNICAL FIELD

Example embodiments generally relate to microwave or radio frequency (RF) equipment and, more particularly, some embodiments relate to a circulator provided with at least one port having a different impedance than other ports of the circulator.

BACKGROUND

A circulator is a fundamental component of RF and microwave equipment such as, for example, transmitter multi-couplers that allow radio transmission sites to operate reasonably free of interference. Circulators such as ferrite circulators typically include at least three terminals or ports at which an external waveguide or transmission line connects to the circulator. A signal entering in any port can be transmitted only to the next port in rotation. Moreover, a circulator is a three (or four) terminal, non-reciprocal device that permits RF or microwave energy to flow between two adjacent ports in only one direction.

When only two terminals of the circulator are used, an isolator may be formed. Thus, for example, if one port of a three-port circulator is terminated in a matched load, the circulator may operate as an isolator, allowing signals to travel only in one direction between the two remaining ports.

Impedance matching is an important consideration when connecting a circulator/isolator to external equipment. In the past, circulators/isolators have generally been provided with a junction impedance of 50 ohms. The provision of a stable and precise 50 ohm junction impedance for each port of the circulator/isolator, has been adopted as an industry standard so that each port can have a predictable impedance. However, a byproduct of this standard has been that in many cases, loads that may need to be served could have impedances of something other than 50 ohms.

Given that the natural impedance of a circulator/isolator is much less than 50 ohms, most circulators/isolators employ some form of impedance transformation circuitry to generate a final impedance of 50 ohms at the connector port. Accordingly, when an external device having an impedance of less than 50 ohms is to be coupled to the circulator/isolator, further impedance transformation must be employed to transform the impedance back down to the impedance of the external device. The result may be a complex series of cascading impedance transformers that may add to the cost and complexity of the devices.

BRIEF SUMMARY OF SOME EXAMPLES

Some example embodiments may provide an ability to enable designers to avoid the need to employ complicated cascading impedance transformations. In this regard, example embodiments may enable designers to employ different junction impedances at different ports of a circulator. Some example embodiments may therefore improve the ability of designers to provide lower cost and less complex circulators that function well in environments where different loads may be encountered.

In an example embodiment, a circulator is provided. The circulator may include a first port having a first port impedance matching circuit defining an impedance of the first port, a second port having a second port impedance matching circuit defining an impedance of the second port, and a third port having a third port impedance matching circuit defining an impedance of the third port. In an example embodiment, the impedance of the first port may be provided to match an impedance of a first external circuit, the impedance of the second port may be provided to match an impedance of a second external circuit, and the impedance of the third port may be provided to match an impedance of a third external circuit. The impedance of the third port may be different than the impedance of the first port.

In another example embodiment, a power amplifier is provided. The power amplifier may include at least one circulator. The circulator may include a first port having a first port impedance matching circuit defining an impedance of the first port, a second port having a second port impedance matching circuit defining an impedance of the second port, and a third port having a third port impedance matching circuit defining an impedance of the third port. In an example embodiment, the impedance of the first port may be provided to match an impedance of a first external circuit, the impedance of the second port may be provided to match an impedance of a second external circuit, and the impedance of the third port may be provided to match an impedance of a third external circuit. The impedance of the third port may be different than the impedance of the first port.

In another example embodiment, a method of manufacturing a circulator is provided. The method may include providing a substantially Y-shaped conductive strip between upper and lower ferrite pucks. The method may further include providing a first port having a first port impedance matching circuit defining an impedance of the first port extending from a first portion of the conductive strip, providing a second port having a second port impedance matching circuit defining an impedance of the second port extending from a second portion of the conductive strip, and providing a third port having a third port impedance matching circuit defining an impedance of the third port extending from a third portion of the conductive strip. In an example embodiment, the impedance of the first port may be provided to match an impedance of a first external circuit, the impedance of the second port may be provided to match an impedance of a second external circuit, and the impedance of the third port may be provided to match an impedance of a third external circuit. In an example embodiment, the impedance of the third port may be provided to be different than the impedance of the first port.

BRIEF DESCRIPTION OF THE SEVERAL VIEWS OF THE DRAWING(S)

Having thus described the invention in general terms, reference will now be made to the accompanying drawings, which are not necessarily drawn to scale, and wherein:

DETAILED DESCRIPTION

Figure 1:
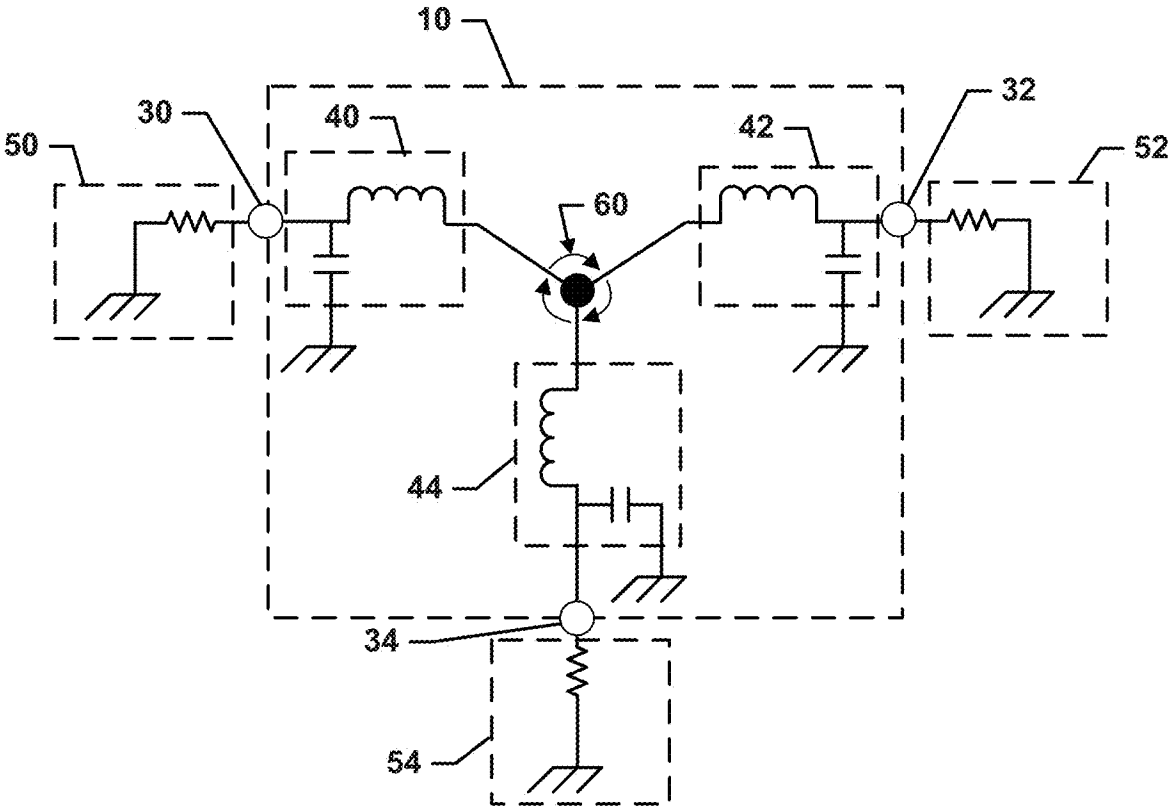
FIG. 1 illustrates a basic conceptual view of a circulator that may be employed within a power amplifier context according to an example embodiment.

Some example embodiments now will be described more fully hereinafter with reference to the accompanying drawings, in which some, but not all example embodiments are shown. Indeed, the examples described and pictured herein should not be construed as being limiting as to the scope, applicability or configuration of the present disclosure. Rather, these example embodiments are provided so that this disclosure will satisfy applicable legal requirements. Like reference numerals refer to like elements throughout. Furthermore, as used herein, the term "or" is to be interpreted as a logical operator that results in true whenever one or more of its operands are true. As used herein, operable coupling should be understood to relate to direct or indirect connection that, in either case, enables functional interconnection of components that are operably coupled to each other.

As indicated above, a circulator may be configured to operate as an isolator. Circulators may also be configured to perform other functions such as, for example, duplexer functions, reflection amplifier functions and/or the like. Accordingly, descriptions herein will be provided in relation to describing a circulator. However, it should be appreciated that the descriptions are equally applicable to isolators or any other possible configuration of the circulator. Moreover, it should also be appreciated that although an example embodiment will be described herein in the context of a three-port circulator, the concepts described herein are equally applicable to other configurations (e.g., a four-port circulator) that may have different numbers of ports.

Additionally, although some basic circuitry is displayed herein including resistors, capacitors, inductors, etc., it should be appreciated that the values and configurations of specific components employed may vary according to different design requirements and objectives. Thus, the capacitors, inductors and/or resistors displayed herein should merely be understood to represent generic circuitry and not specific configurations or values in any limiting sense.

FIG. 1 illustrates a basic conceptual view of a basic circulator 10 that may be employed within a power amplifier context. As shown in FIG. 1, the circulator 10 has three ports (e.g., a first port 30, second port 32, and third port 34), each of which employs a port impedance matching circuit (e.g., first port impedance matching circuit 40, second port impedance matching circuit 42 and third port impedance matching circuit 44). Each port is operably coupled to external circuitry (e.g., first external circuit 50, second external circuit 52 and third external circuit 54) that may operate as a source or load for various configurations. Power may enter into any one of the ports and exit through an adjacent port after circulating in the direction shown by arrows 60. In operation, an external magnetic field is applied to the circulator 10 to cancel out internal circulating currents other than the desired path for energy "circulation," as described in greater detail below. The circulator 10 may therefore be a useful device for selective coupling of different ports where isolation of ports not currently coupled is desired. In some embodiments, the circulator 10 may be useful in connection with configuration such that one or more of the external circuits may operate as a power amplifier or any of a number of other devices used for RF or microwave applications.

As mentioned above, in a typical circulator, the first port impedance matching circuit 40, the second port impedance matching circuit 42 and the third port impedance matching circuit 44 would each be provided to present a stable and accurate 50 ohm impedance at the first port 30, the second port 32, and the third port 34, respectively. However, example embodiments enable the provision of at least one different impedance value on at least one of the ports. For example, the first and second ports 30 and 32 may employ corresponding first and second port impedance matching circuits 40 and 42 that are configured to provide an impedance of 50 ohms to match the impedance of the corresponding first and second external circuits 50 and 52. Meanwhile, the third port 34 may employ the third port impedance matching circuit 44 to have a 12.5 ohm impedance to match the impedance of the third external circuit 54.

As used in the present context, the term "different impedance value" or discussions regarding differences in impedance values should be understood to represent larger than mere de minimis differences between impedance values. In this regard, differences in impedance values should be understood to represent noticeable and relatively significant changes in impedance values when the impedance value of one port is compared to the impedance value of another port. In some cases, an impedance value may be considered to be "different" with as little as 1% difference for relatively large impedance values. However, in the context of a typical 50 ohm output impedance, according to one example embodiment, one port impedance may be at least 10% different (i.e., 5 ohms). In other examples, the difference may be larger (e.g., 20%, 50% or more).

By providing at least one port with a different impedance value, the employment of additional transformation circuits can be avoided. Since impedance transformers are often realized by cascading multiple 90 degree lengths of transmission lines, avoiding the use of multiple quarter-wave transmission lines by employing an example embodiment can enable designers to achieve relatively significant size reductions. Moreover, complication and cost of manufacturing circulators and the components in which the circulators function may also be reduced by employing example embodiments. Lower impedances of certain components such as large power transistors may therefore be coupled to the ports (e.g., as examples of the external circuitry) and can be accommodated with lower impedance values of the corresponding ports.

Figure 2:
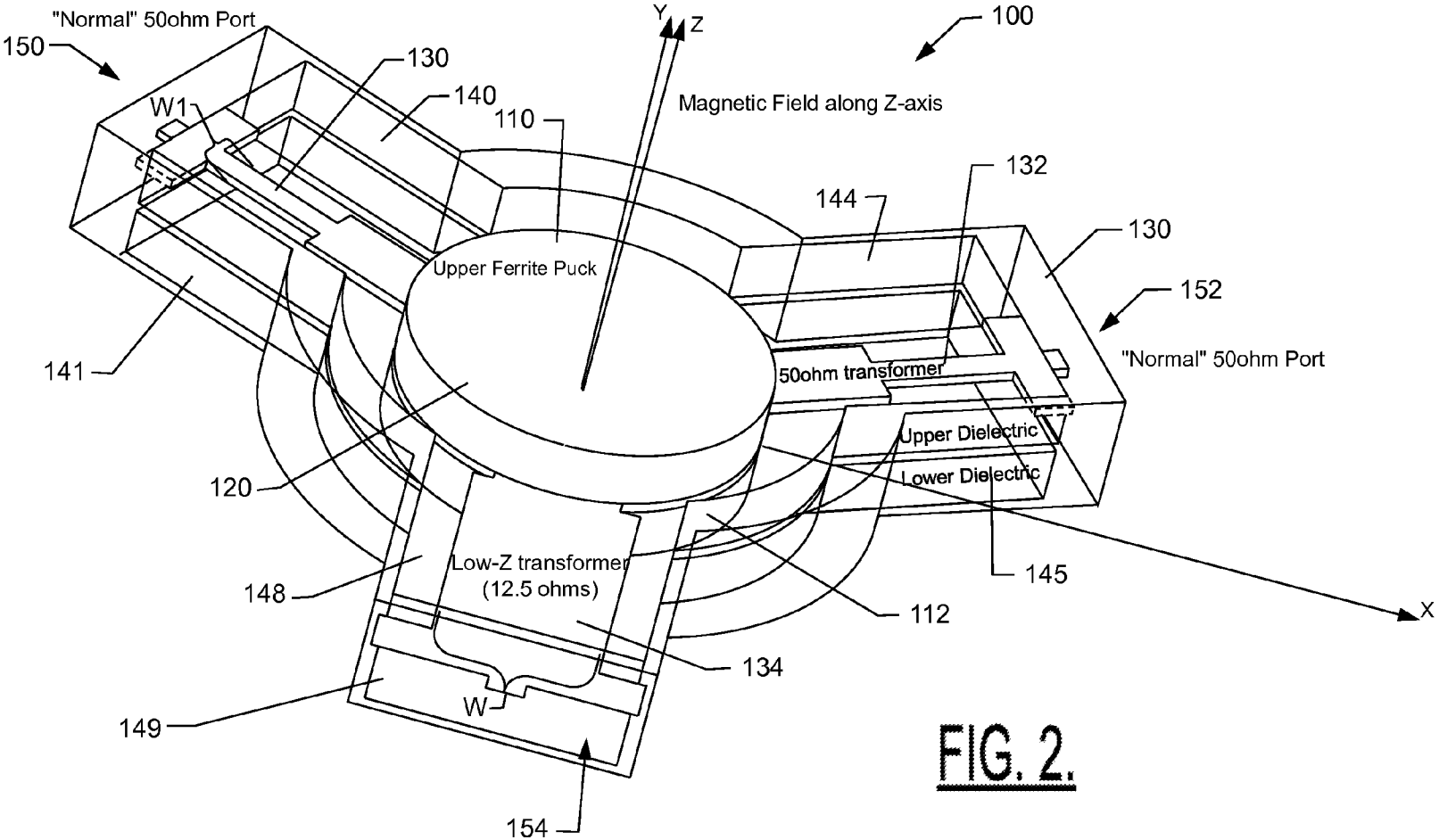
FIG. 2 illustrates a three-dimensional view of a circulator according to an example embodiment of an example embodiment.

FIG. 2 illustrates a three-dimensional view of a circulator 100 according to an example embodiment. The circulator 100 of FIG. 2 may be an example of the circulator 10 described in connection with FIG. 1. As shown in FIG. 2, the circulator 100 may include an upper ferrite puck 110 and a lower ferrite puck 112 that may be disposed on opposing sides of a transmission medium 120. The transmission medium 120 may extend in each of three directions that may be disposed substantially 120 degrees apart from each other. In some cases, ends of the transmission medium 120 may be operably coupled to a first transformer 130, a second transformer 132 and a third transformer 134, respectively. Thus, the transmission medium 120 may be a substantially Y-shaped material formed as a conductive strip line or trace.

The first transformer 130, the second transformer 132 and the third transformer 134 may each be disposed between an upper dielectric and a lower dielectric to form a component having a desired and predictable impedance. Thus, for example, the first transformer 130 may be disposed between upper dielectric 140 and lower dielectric 141. The second transformer 132 may be disposed between upper dielectric 144 and lower dielectric 145. The third transformer 134 may be disposed between upper dielectric 148 and lower dielectric 149.

The first transformer 130, the upper dielectric 140 and the lower dielectric 141 may correspond to the first port impedance matching circuit 40 of FIG. 1. The second transformer 132, the upper dielectric 144 and the lower dielectric 145 may correspond to the second port impedance matching circuit 42 of FIG. 1. The third transformer 134, the upper dielectric 148 and the lower dielectric 149 may correspond to the third port impedance matching circuit 44 of FIG. 1. The first transformer 130, the second transformer 132 and the third transformer 134 may be operably coupled to respective ones of a first port 150, a second port 152 and a third port 154 (which may correspond to the first port 30, the second port 32, and the third port 34, respectively, of FIG. 1). The first port 150, the second port 152 and the third port 154 may each be connected to equipment of a power amplifier or may be connected to any other sources and loads that may be desirable for configuration in a context of the designer's choosing. In an example in which at least one port has a different impedance value than the other ports, the impedance of the first port 150 and the second port 152 may be provided to be 50 ohms and the impedance of the third port 154 may be 12.5 ohms. Although it should be appreciated that other impedance values could be employed in accordance with other example embodiments, in this example, the first port 150 and the second port 152 may be coupled to 50 ohm loads and the third port 154 may be coupled to external circuitry (e.g., in the context of high power device interfaces) that matches the impedance of the third port (i.e., a 12.5 ohm load).

In an example embodiment, the first transformer 130, the second transformer 132 and the third transformer 134 may have physical dimensions selected to achieve a desired port impedance value for a given dielectric material. Thus, for example, the upper dielectrics 140, 144 and 148 may each be made of the same material and the lower dielectrics 141, 145 and 149 may also each be made of the same material. Except to the extent that changes in dimensions of the transformers of each respective port necessitate corresponding changes in the dimensions of the dielectric portions associated with each respective port, the dielectric portions may also have the same or similar dimensions. In this example embodiment, the impedance values associated with each port may be provided at least in part based on the dimensions (e.g., length, height and width) of the conductive paths provided by the first transformer 130, the second transformer 132 and the third transformer 134. More particularly, differences in impedance values between the ports may be provided on the basis of changes to the dimensions of the transformers of at least one of the ports. Accordingly, if the first port 150 and the second port 152 have the same value of impedance and the third port 154 has a different value, then the first and second transformers 130 and 132 may have substantially the same dimensions, but the dimensions of the third transformer 134 may be different.

In accordance with an example embodiment, it may be desirable to provide the overall size or dimensions of the circulator 100 symmetrical or otherwise consistent. Thus, the lengths of the transformers may desirably be held substantially the same. Accordingly, to achieve a lower impedance value (as is the case in this example) for the third port 154, the third transformer 134 may have a larger size or conductive area provided by increasing the height and/or width (W) of the third transformer 134 relative to the height and/or width (W1) employed for the first and second transformers 130 and 132. In this example, only the width dimension may be altered. However, it should be appreciated that any one of the dimensions (or even multiple ones of the dimensions) may be altered in accordance with other example embodiments.

In an alternative embodiment, provision of a different impedance value for the third port 154 than the impedance values of the first port 150 and the second port 152 may be accomplished without changing the dimensions of the transformers, but instead by changing the dielectric materials employed. Thus, for example, the dimensions (e.g., height and width) of the first transformer 130, the second transformer 132 and the third transformer 134 may be substantially the same. However, the dielectric materials of the upper dielectric 148 and lower dielectric 149 may be selected to have different properties than the dielectric materials employed in the upper dielectrics 140 and 144 and lower dielectrics 141 and 145 of the first and second ports 150 and 152, thereby resulting in different impedance values for the third port 154 than for the first and second ports 150 and 152.

In still other embodiments, both modifications in transformer dimensions and to dielectric materials employed may be used to achieve a different impedance value for at least one of the ports. Thus, for example, the third port 154 may employ both different dielectric materials and a different transformer size than the dielectric materials and transformer sizes employed in the first and second ports 150 and 152.

It should also be appreciated that in some embodiments, whether through modification of transformer size, dielectric material selection or both, each of the first port 150, the second port 152 and the third port 154 may have different impedance values, if desired. Furthermore, it should be appreciated that in some cases it may be desirable to have consistent overall sizes and/or dimensions for the first port 150, the second port 152 and the third port 154 to facilitate a standard port size for ease of integration with external components. Thus, while the overall dimensions of the ports remain fixed such that they must match each other, the components used to select the impedance of each port may be modified in any desirable way that can achieve both the desired impedance and still fit within the requirements of the overall dimensions of the ports.

When RF or microwave energy is applied to one of the ports (e.g., the first port 140), counter-rotating electromagnetic fields of equal amount are induced in the upper ferrite puck 110 and the lower ferrite puck 112. An external, axial magnetic field may be applied to the upper ferrite puck 110 and the lower ferrite puck 112. If the magnetic field is applied at an appropriate intensity, the counter-rotating fields can be made to cancel over one of the adjacent transmission lines. Meanwhile, the fields may reinforce each other over the remaining adjacent transmission line. Thus, the RF or microwave energy may flow with relatively little attenuation between two adjacent transmission lines, but may not flow at all into the other transmission line. Accordingly, "circulation" is achieved within the circulator 100.

As such, in an example embodiment, a magnetic field may be applied along the z-axis of FIG. 2 in order to induce proper operation of the circulator 100 to enable power provided into the first port 150 to be communicated to the second port 152, while preventing power transfer to the third port 154. Alternatively, power provided into the second port 152 may be communicated to the third port 154, while preventing power transfer to the first port 150. As still another alternative, power provided into the third port 154 may be communicated to the first port 150, while preventing power transfer to the second port 152.

In the example case in which power is transferred between the first port 150 and the second port 152, the impedances of the first port 150 and the second port 152 are the same. However, in the other examples, the impedance of at least one port (i.e., the third port 154) is different than the impedance of the other ports (i.e., the first port 150 and the second port 152). Accordingly, diverse external circuitry may be accommodated without requiring the use of complicated chains of impedance matching transformers. Instead, the impedance matching may be accomplished within the circulator itself to reduce complication and cost. Example embodiments may broaden the frequency bands over which some components are capable of operating. In this regard, for example, the example embodiment having a 12.5 ohm port may provide excellent performance over about a 1 to 2 GHz band. However, other bands may also be serviced.

Figure 3:
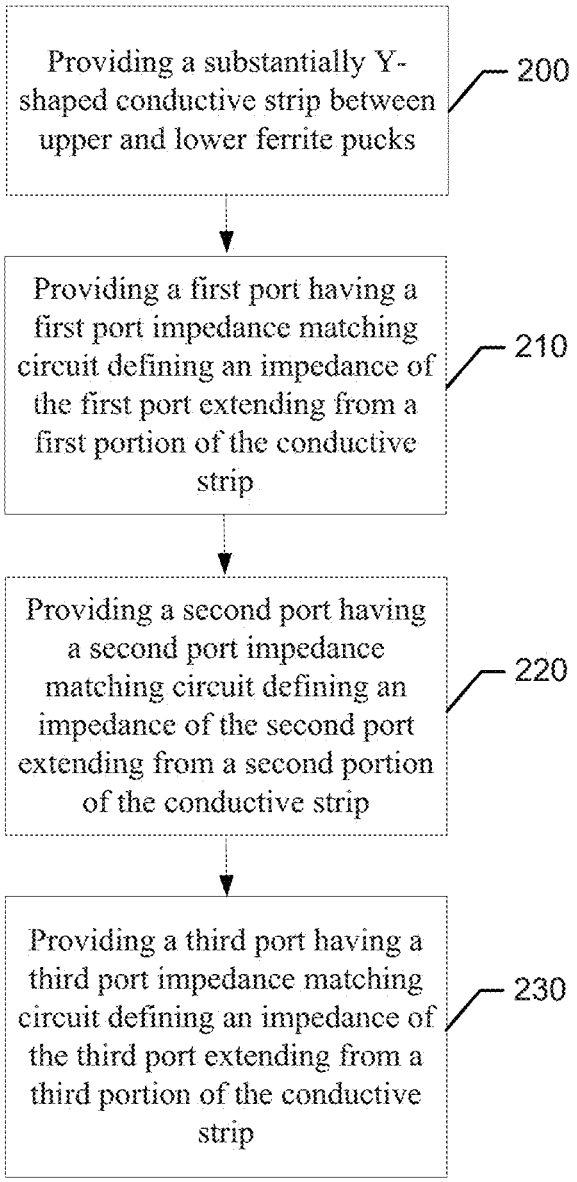
FIG. 3 illustrates a block diagram of a method of manufacturing a circulator in accordance with an example embodiment.

FIG. 3 illustrates a block diagram associated with a method of manufacturing or otherwise providing a circulator in accordance with an example embodiment. As shown in FIG. 3, the method may include providing a substantially Y-shaped conductive strip between upper and lower ferrite pucks at operation 200. The method may further include providing a first port having a first port impedance matching circuit defining an impedance of the first port extending from a first portion of the conductive strip at operation 210, providing a second port having a second port impedance matching circuit defining an impedance of the second port extending from a second portion of the conductive strip at operation 220, and providing a third port having a third port impedance matching circuit defining an impedance of the third port extending from a third portion of the conductive strip at operation 230. In an example embodiment, the impedance of the first port may be provided to match an impedance of a first external circuit, the impedance of the second port may be provided to match an impedance of a second external circuit, and the impedance of the third port may be provided to match an impedance of a third external circuit. In an example embodiment, the impedance of the third port may be provided to be different than the impedance of the first port. In some embodiments, the impedance of the third port may be provided to be different than the impedance of the first port by altering one or both of dielectric materials used and dimensions of conductive materials used to define the first port impedance matching circuit and the third port impedance matching circuit.

Many modifications and other embodiments of the inventions set forth herein will come to mind to one skilled in the art to which these inventions pertain having the benefit of the teachings presented in the foregoing descriptions and the associated drawings. Therefore, it is to be understood that the inventions are not to be limited to the specific embodiments disclosed and that modifications and other embodiments are intended to be included within the scope of the appended claims. Moreover, although the foregoing descriptions and the associated drawings describe exemplary embodiments in the context of certain exemplary combinations of elements and/or functions, it should be appreciated that different combinations of elements and/or functions may be provided by alternative embodiments without departing from the scope of the appended claims. In this regard, for example, different combinations of elements and/or functions than those explicitly described above are also contemplated as may be set forth in some of the appended claims. In cases where advantages, benefits or solutions to problems are described herein, it should be appreciated that such advantages, benefits and/or solutions may be applicable to some example embodiments, but not necessarily all example embodiments. Thus, any advantages, benefits or solutions described herein should not be thought of as being critical, required or essential to all embodiments or to that which is claimed herein. Although specific terms are employed herein, they are used in a generic and descriptive sense only and not for purposes of limitation.

That which is claimed:

1. A circulator comprising:

a first port having a first port impedance matching circuit defining an impedance of the first port;

a second port having a second port impedance matching circuit defining an impedance of the second port; and a third port having a third port impedance matching circuit defining an impedance of the third port, wherein the impedance of the first port is provided to match an impedance of a first external circuit, the impedance of the second port is provided to match an impedance of a second external circuit, and the impedance of the third port is provided to match an impedance of a third external circuit, wherein the impedance of the third port is different than the impedance of the first port, wherein the first port impedance matching circuit comprises a first upper dielectric material and a first lower dielectric material disposed on opposing sides of a first transformer, wherein the second port impedance matching circuit comprises a second upper dielectric material and a second lower dielectric material disposed on opposing sides of a second transformer, wherein the third port impedance matching circuit comprises a third upper dielectric material and a third lower dielectric material disposed on opposing sides of a third transformer, wherein the first upper dielectric material is different than the third upper dielectric material, and wherein the first lower dielectric material is different than the third lower dielectric material.

2. The circulator of claim 1, wherein the impedance of the first port is substantially the same as the impedance of the second port.

3. The circulator of claim 1, wherein the impedance of the third port is different than the impedance of the first port by at least 20% of the impedance of the third port.

4. The circulator of claim 1, wherein a width dimension of the third transformer is different than a width dimension of the first transformer.

5. The circulator of claim 1, wherein dimensions of the first, second and third transformers are substantially the same.

6. The circulator of claim 1, wherein dimensions of the third transformer are different than dimensions of the first transformer.

7. The circulator of claim 1, wherein the impedance of the first port is about 50 ohms and the impedance of the third port is less than 50 ohms.

8. A power amplifier including at least one circulator comprising:

a first port having a first port impedance matching circuit defining an impedance of the first port;

a second port having a second port impedance matching circuit defining an impedance of the second port; and a third port having a third port impedance matching circuit defining an impedance of the third port, wherein the impedance of the first port is provided to match an impedance of a first external circuit, the impedance of the second port is provided to match an impedance of a second external circuit, and the impedance of the third port is provided to match an impedance of a third external circuit, wherein the impedance of the third port is different than the impedance of the first port wherein the first port impedance matching circuit comprises a first upper dielectric material and a first lower dielectric material disposed on opposing sides of a first transformer, wherein the second port impedance matching circuit comprises a second upper dielectric material and a second lower dielectric material disposed on opposing sides of a second transformer, wherein the third port impedance matching circuit comprises a third upper dielectric material and a third lower dielectric material disposed on opposing sides of a third transformer, wherein the first upper dielectric material is different than the third upper dielectric material, and wherein the first lower dielectric material is different than the third lower dielectric material.

9. The power amplifier of claim 8, wherein the impedance of the first port is substantially the same as the impedance of the second port.

10. The power amplifier of claim 8, wherein the impedance of the third port is different than the impedance of the first port by at least 20% of the impedance of the third port.

11. The power amplifier of claim 8, wherein a width dimension of the third transformer is different than a width dimension of the first transformer.

12. The power amplifier of claim 8, wherein the first upper dielectric material is different than the third upper dielectric material, wherein the first lower dielectric material is different than the third lower dielectric material, and wherein dimensions of the first, second and third transformers are substantially the same.

13. The power amplifier of claim 8, wherein dimensions of the third transformer are different than dimensions of the first transformer.

14. The power amplifier of claim 8, wherein the impedance of the first port is about 50 ohms and the impedance of the third port is less than 50 ohms.

* * * * *